US012491558B2

(12) United States Patent
Wang et al.

(10) Patent No.: US 12,491,558 B2
(45) Date of Patent: Dec. 9, 2025

(54) HIGH-INERTIA MOLD SHELL FOR CASTING AND PREPARATION METHOD THEREOF AND METHOD FOR IMPROVING PRECISION OF MAGNESIUM ALLOY CAST

(71) Applicant: DEKAI INTELLIGENT CASTING CO., LTD, Baoding (CN)

(72) Inventors: Kai Wang, Baoding (CN); Chong Shao, Baoding (CN); Hailong Wu, Baoding (CN); Xiaoping Zhu, Baoding (CN); Xueyan Mo, Baoding (CN); Zongwen Zheng, Baoding (CN); Wuqiang Yang, Baoding (CN); Chunlei Zhu, Baoding (CN); Changyong Xing, Baoding (CN)

(73) Assignee: DEKAI INTELLIGENT CASTING CO., LTD, Baoding (CN)

( * ) Notice: Subject to any disclaimer, the term of this patent is extended or adjusted under 35 U.S.C. 154(b) by 0 days.

(21) Appl. No.: 18/003,935

(22) PCT Filed: Jul. 7, 2022

(86) PCT No.: PCT/CN2022/104254
§ 371 (c)(1),
(2) Date: Dec. 30, 2022

(87) PCT Pub. No.: WO2023/109101
PCT Pub. Date: Jun. 22, 2023

(65) Prior Publication Data

US 2024/0316620 A1 Sep. 26, 2024

(30) Foreign Application Priority Data

Dec. 13, 2021 (CN) ..... 202111514160.4

(51) Int. Cl.

| | |
|---|---|
| ***B22C 3/00*** | (2006.01) |
| ***B22C 1/16*** | (2006.01) |
| ***B22C 9/02*** | (2006.01) |
| ***B22D 21/04*** | (2006.01) |

(52) U.S. Cl.
CPC ..... *B22C 3/00* (2013.01); *B22C 1/165* (2013.01); *B22C 9/02* (2013.01); *B22D 21/04* (2013.01)

(58) Field of Classification Search
CPC .. B22C 1/165; B22C 3/00; B22C 9/02; B22C 1/16; B22C 9/04; B22C 9/12; B22D 21/04
See application file for complete search history.

(56) References Cited

U.S. PATENT DOCUMENTS

2009/0263638 A1 10/2009 Faber et al.

FOREIGN PATENT DOCUMENTS

| | | | | |
|---|---|---|---|---|
| CN | 1212242 | | 3/1999 | |
| CN | 101268027 | | 9/2008 | |
| CN | 103231016 | | 8/2013 | |
| CN | 103480796 | | 1/2014 | |
| CN | 105014011 | | 11/2015 | |
| CN | 105436409 | | 3/2016 | |
| CN | 105522112 | | 4/2016 | |
| CN | 105750483 | | 7/2016 | |
| CN | 105750488 | | 7/2016 | |
| CN | 107052230 | | 8/2017 | |
| CN | 110976758 | | 4/2020 | |
| CN | 110976758 | A * | 4/2020 | ..... B22C 3/00 |
| CN | 113894251 | | 1/2022 | |
| CN | 113976841 | | 1/2022 | |
| CN | 114561195 | | 5/2022 | |
| DE | 102004038288 | | 9/2005 | |
| JP | 2014-62729 | | 4/2014 | |
| RU | 442001 | A1 * | 9/1974 | |

OTHER PUBLICATIONS

PCT International Application No. PCT/CN22/104254, International Search Report and Written Opinion of the International Searching Authority, dated Dec. 13, 2021, 11 pages.
Chinese Patent Application No. 202111514160.4, Notification to Grant Patent Right for Invention, Jan. 27, 2022, 3 pages.
Chinese Patent Application No. 202111514160.4, Search Report, 2022, 2 pages.

* cited by examiner

*Primary Examiner* — Shuangyi Abu Ali
(74) *Attorney, Agent, or Firm* — DLA Piper LLP (US)

(57) ABSTRACT

The present disclosure belongs to the technical field of casting, and specifically relates to a high-inertia mold shell for casting, a preparation method thereof, and a method for improving precision of a magnesium alloy cast. The high-inertia mold shell for casting includes a surface layer, which is configured to contact a magnesium alloy pouring liquid, wherein the surface layer contains an inorganic compound, and the inorganic compound is at least one selected from the group consisting of boric anhydride, borax, potassium fluoride, and sodium fluoride; and in the above, based on a total amount of raw materials of the surface layer, a content of the inorganic compound accounts for 10-40 wt %.

6 Claims, No Drawings

HIGH-INERTIA MOLD SHELL FOR CASTING AND PREPARATION METHOD THEREOF AND METHOD FOR IMPROVING PRECISION OF MAGNESIUM ALLOY CAST

CROSS-REFERENCE TO RELATED APPLICATION

This application is the National Stage filing under 35 U.S.C. 371 of International Application No. PCT/CN2022/014254, filed Jul. 7, 2022, which claims priority to Chinese Patent Application Number 202111514160.4, filed Dec. 13, 2021, which are incorporated by reference in their entireties.

TECHNICAL FIELD

The present disclosure belongs to the technical field of casting, and specifically relates to a high-inertia mold shell for casting and a preparation method thereof and a method for improving precision of a magnesium alloy cast.

BACKGROUND ART

In the prior art, the magnesium alloy is generally prepared by sand casting or pressure casting. A mold cavity for sand casting is usually made of sand, and a binder of the sand is generally resin or aluminum trioxide (clay), etc.

During sand casting, components such as sulfur, carbon powder, and boric acid are usually added to a surface layer, wherein the sulfur is oxidized when being heated to generate sulfur dioxide, and the sulfur dioxide reacts with magnesium in a magnesium-alloy pouring liquid to generate magnesium sulfide. The magnesium sulfide is a dense layer and forms a protective film so that the magnesium no longer continues to react with the sand; if the magnesium sulfide dense layer cracks, it will react with sand (e.g., silica) and the heat it conducts causes the boric acid to lose water and generate an enamel layer, preventing the magnesium liquid and the sand from further reaction. As the boric acid has a boiling point about 300° C., and the temperature of the mold cavity is a normal temperature in the sand casting, the problem of protection for the magnesium alloy in the sand casting can be solved by adding the boric acid to the sand mold and cooperating with sulfur.

However, in the precision casting of magnesium alloy, the surface layer of the mold shell is usually added with boric acid, but sulfur is not added, because if the sulfur is added, the sulfur will burn and volatilize during calcination. However, as the mold shell also should be subjected to a high-temperature sintering treatment, boric acid having a low boiling point is easy to volatilize during the high-temperature sintering, and the mold shell has a relatively high porosity after sintering, the magnesium alloy pouring liquid will react with oxygen (through pores), and a large amount of heat is generated from the reaction to raise local temperature of the magnesium alloy pouring liquid, so that the magnesium alloy pouring liquid further reacts with the mold shell (main components thereof are silicon oxide and aluminum oxide), that is, the high-temperature magnesium alloy pouring liquid will directly react with the mold shell, and cannot play a role in protecting the magnesium alloy, so that the investment casting of magnesium alloy becomes a problem in the industry.

Therefore, there is a need in the art to develop a high-inertia mold shell applicable to precision casting of magnesium alloy.

SUMMARY

The present disclosure provides a high-inertia mold shell for casting, including a surface layer, which is configured to contact a magnesium alloy pouring liquid, wherein the surface layer contains an inorganic compound, and the inorganic compound is at least one selected from the group consisting of boric anhydride, borax, potassium fluoride, and sodium fluoride; and in the above, based on a total amount of raw materials of the surface layer, a content of the inorganic compound accounts for 10-40 wt %.

In some embodiments, the content of the inorganic compound accounts for 10-30 wt %.

In some embodiments, the inorganic compound satisfies that a melting point is 300-800° C. and a boiling point is greater than or equal to 1000° C. (≥1000° C.).

In some embodiments, the inorganic compound is at least one selected from the group consisting of boric anhydride, borax, potassium fluoride, and sodium fluoride.

In some embodiments, the inorganic compound is boric anhydride.

In some embodiments, the surface layer further contains a first binder, a first sand material, and an optional first powder, and based on the total amount of raw materials of the surface layer, a content of the first binder by wet weight accounts for 5-15 wt %, the content of the first powder accounts for 0-25 wt %, and a content of the first sand material accounts for 20-85 wt %.

In some embodiments, a ratio of the thickness of the surface layer to a total thickness of the high-inertia mold shell for casting is 2.5-25:100.

In some embodiments, the high-inertia mold shell for casting has a total thickness of 4-20 mm, and the surface layer has a thickness of 0.5-1 mm.

In some embodiments, the inorganic compound has a particle size of 100-300 mesh.

In some embodiments, the high-inertia mold shell for casting further includes:

- a transition layer, which is provided on a side of the surface layer; and
- a reinforcement layer, which is provided on a side of the transition layer away from the surface layer, wherein
- a ratio of the thickness of the surface layer, the thickness of the transition layer, and the thickness of the reinforcement layer is 1:2-3:7.5-15.

The present disclosure further provides a method for preparing the high-inertia mold shell for casting according to any one of the above, including: preparing a surface layer slurry and preparing a surface layer sand material, wherein an inorganic compound is introduced into the surface layer slurry and/or the surface layer sand material.

In some embodiments, a weight ratio of the inorganic compound introduced into the surface layer slurry to the inorganic compound introduced into the surface layer sand material is 1:8-30.

In some embodiments, the inorganic compound has a particle size of 100-300 mesh.

In some embodiments, a first binder and a first powder are further introduced into the surface layer slurry, and a weight ratio of the first powder to the first binder in the surface layer slurry is 1-10:1; moreover, a first sand material is further introduced into the surface layer sand material, and a weight ratio of the inorganic compound to the first sand material in the surface layer sand material is 15-40:100.

In some embodiments, the viscosity of the surface layer slurry is 20-26 seconds as measured by a flow cup.

In some embodiments, the method for preparing the high-inertia mold shell for casting further includes the following steps:

(1) covering the surface layer slurry and the surface layer sand material in sequence on a wax mold surface, and then performing first drying for forming a surface layer;

(2) making a transition layer and a reinforcement layer in sequence on a surface of the surface layer; and (3) sealing a surface of a product obtained in step (2), followed by drying, wax mold removal, and shell baking.

The present disclosure further provides a method for improving precision of a magnesium alloy cast, wherein the high-inertia mold shell for casting according to any one of the above is used for precision casting.

The present disclosure further provides use of the high-inertia mold shell for casting according to any one of the above in improving precision of a magnesium alloy cast.

In some embodiments, the high-inertia mold shell for casting is used for precision casting in the preparation of the magnesium alloy cast.

DETAILED DESCRIPTION OF EMBODIMENTS

Endpoints and any values of ranges disclosed herein are not limited to the precise ranges or values, and these ranges or values should be understood to contain values proximate to those ranges or values. For numerical ranges, one or more new numerical ranges can be obtained by combining endpoint values of various ranges, endpoint values and individual point values of various ranges, and individual point values, and these numerical ranges should be considered as disclosed herein.

As described in the preceding, the present disclosure provides a high-inertia mold shell for casting, including a surface layer, which is configured to contact a magnesium alloy pouring liquid, the surface layer contains an inorganic compound, and the inorganic compound satisfies that the inorganic compound has a melting point lower than the temperature of the magnesium alloy pouring liquid and a boiling point higher than the temperature of the magnesium alloy pouring liquid; in the above, based on a total amount of raw materials of the surface layer, a content of the inorganic compound accounts for 10-40 wt %. In some embodiments, the content of the inorganic compound may account for 15-35 wt %, 17-31 wt % or 20-28 wt %, such as 10 wt %, 15 wt %, 20 wt %, 25 wt %, 30 wt %, 35 wt % or 40 wt %. A suitable amount of specific inorganic compound is used in the present disclosure. The inorganic compound does not volatilize during sintering of the mold shell; during pouring, the inorganic compound will form a molten state due to the high-temperature action of the magnesium alloy pouring liquid, can fill pores in the surface layer of the mold shell, and can well isolate magnesium and the mold shell, and avoid reaction of the magnesium alloy with $SiO_2$ and $Al_2O_3$ in the mold shell; the boiling point of the inorganic compound should not be too small, as the inorganic compound will volatize and cannot form protection if the boiling point is smaller than the temperature of the magnesium alloy pouring liquid or the calcination temperature of the mold shell. Under the same condition, if the amount of the inorganic compound is too large, the strength of the mold shell will be affected, and the surface layer will be caused to fall off and swell, and if the amount of the inorganic compound is too small, a dense film cannot be effectively formed, thus a good protective effect cannot be achieved.

Due to the above protection principle, the high inertia effect of the present disclosure can be achieved without limiting the porosity of the mold shell in the present disclosure.

In the present disclosure, it can be understood that the mold shell may be in a regular shape, such as cuboid or spherical, or may be in an irregular shape, such as cuboid with an inwardly concave bottom, all of which can be used in the present disclosure, and are not limited in any way in the present disclosure.

The present disclosure can be used for any casting that needs to prevent the reaction between the magnesium alloy pouring liquid and the mold shell, including but not limited to the magnesium alloy pouring liquid, as long as the above embodiments are used, the protective effects of the present disclosure can be achieved.

In some embodiments, the content of the inorganic compound accounts for 10-30 wt %. In some embodiments, the proportion of the content of the inorganic compound may be, for example, any value of 11 wt %, 12 wt %, 13 wt %, 14 wt %, 15 wt %, 16 wt %, 17 wt %, 18 wt %, 20 wt %, 24 wt %, 26 wt %, 28 wt %, and 30 wt % or any value between two adjacent point values. With the content of the inorganic compound being within the above range, the content of the inorganic compound is appropriate, a protective film with a suitable thickness can be obtained, and meanwhile the raw materials are saved. Optionally, the content of the inorganic compound accounts for 11-16 wt %. In this optional embodiment, the content of the inorganic compound is more appropriate, the protective film with a more appropriate thickness can be obtained, and meanwhile the raw materials are further saved.

A person skilled in the art could select the inorganic compound having appropriate melting point and boiling point according to the temperature of the magnesium alloy pouring liquid.

In an optional embodiment, the inorganic compound satisfies that the melting point is 300-800° C. and the boiling point is greater than or equal to 1000° C. (i.e., ≥1000° C.). This optional embodiment is more suitable for magnesium alloy casting.

The melting point of the inorganic compound is 300-800° C., for example, the melting point may be 350-750° C., 400-700° C. or 450-650° C., for instance, the melting point may be any value of 300° C., 350° C., 400° C., 450° C., 500° C., 550° C., 600° C., 650° C., 700° C. 750° C., and 800° C., and any value between adjacent point values.

The boiling point of the inorganic compound is 1000° C. or more, and may be any value of 1000° C., 1050° C., 1100° C., 1150° C., 2000° C., 3050° C., etc., and any value between adjacent point values.

In the embodiments of the present disclosure, the type of inorganic compound may be selected based on the temperature of the magnesium alloy pouring liquid and the above melting point and boiling point that need to be satisfied.

In an optional embodiment, the inorganic compound is at least one selected from the group consisting of boric anhydride, borax, potassium fluoride, and sodium fluoride.

Optionally, the inorganic compound is boric anhydride. In this optional embodiment, a reaction $B_2O_3+3Mg=2B+3MgO$ also will take place, and the simple substance boron generated will be embedded into a surface film of magnesium oxide to enable the same to become a denser film, thereby achieving the purpose of further isolating the magnesium and the mold shell and thus having a stronger protective effect.

In some embodiments, the surface layer further contains conventional components such as a binder and a sand material, and a person skilled in the art could select various required conventional components and their amounts contained in the surface layer based on actual requirements of surface layer molding and other aspects.

In an optional embodiment, the surface layer further contains a first binder, a first sand material, and an optional first powder, wherein based on the total amount of the raw materials of the surface layer, the content of the first binder by wet weight accounts for 5-15 wt %, for example, the content of the first binder may be 5 wt %, 8 wt %, 10 wt %, 12 wt %, 14 wt %, and 15 wt %; the content of the first powder accounts for 0-25 wt %, such as 0 wt %, 1 wt %, 2 wt %, 4 wt %, 6 wt %, 8 wt %, 10 wt %, 12 wt %, 14 wt %, 16 wt %, 18 wt %, 20 wt %, 22 wt %, 24 wt %, and 25 wt %; the content of the first sand material accounts for 20-85 wt %, such as 20 wt %. 30 wt %, 40 wt %, 50 wt %. 60 wt %, 70 wt %, 80 wt %, and 85 wt %. It is believed that without being bound by theory, in an optional embodiment of the present disclosure, the surface layer not only has a protective effect, but also has suitable strength and other properties, and does not crack after being dried.

In the present disclosure, the types of the first binder, the first sand material, and the first powder are not limited, and they may be the binder, the sand material, or the powder for molding any surface layer existing in the art. Exemplarily, the first binder may include a silicon-containing binder, for example, the first binder may include at least one of silica sol, water glass, and ethyl silicate solution. Exemplarily, the first powder may include at least one of zirconium powder, quartz powder, and mullite powder. Exemplarily, the first sand material includes at least one of corundum sand, quartz sand, and zircon sand.

A person skilled in the art could select whether the surface layer contains the first powder or not according to actual needs (for example, requirements for preparing a surface layer slurry).

In the present disclosure, in the case of containing the inorganic compound, the conventionally added first powder may not be contained, and the inorganic compound and the first binder may be mixed for forming the surface layer slurry, so as to facilitate the molding of the surface layer. That is, the inorganic compound of the present disclosure can serve a protective effect, and can act as a powder for the surface layer molding. However, in the conventional solutions, the first binder and the first powder should be first formed into a surface layer slurry, and then the first sand is applied, thus the surface layer must contain the first powder.

According to the present disclosure, optionally, the ratio of the thickness of the surface layer to the total thickness of the high-inertia mold shell for casting is 2.5-25:100, for example, the ratio may be 3-20:100, 4-18:100 or 4-16:100, such as 2.5:100, 5:100, 7:100, 9:100, 11:100, 13:100, 15:100, 17:100, 19:100, 21:100, 23:100, and 25:100. With the ratio of the thickness of the surface layer to the total thickness of the high-inertia mold shell for casting being within the above range, the economical manufacturing of the mold shell is facilitated while ensuring high inertia and strength of the mold shell. Optionally, the ratio of the thickness of the surface layer to the total thickness of the high-inertia mold shell for casting is 5-15:100. In this optional embodiment, the economical manufacturing of the mold shell is further facilitated, a thinner surface layer is also easy to clean, and meanwhile, the high inertia and strength of the mold shell are further ensured.

In an optional embodiment, the high-inertia mold shell for casting has a total thickness of 4-20 mm, such as 4 mm, 6 mm, 8 mm, 10 mm, 12 mm, 14 mm, 16 mm, 18 mm, and 20 mm; and the surface layer has a thickness of 0.5-1 mm, such as 0.5 mm, 0.6 mm, 0.7 mm, 0.8 mm, 0.9 mm, and 1 mm.

According to the present disclosure, the high-inertia mold shell for casting has a conventional structure of mold shell in the art. In an optional embodiment, the high-inertia mold shell for casting further includes: a transition layer, which is provided on a side of the surface layer; and a reinforcement layer, which is provided on a side of the transition layer away from the surface layer.

A person skilled in the art could select the thickness of the transition layer and the reinforcement layer according to requirements such as dimension and performance of the mold shell. Optionally, a ratio of the thickness of the surface layer, the thickness of the transition layer, and the thickness of the reinforcement layer is 1:2-3:7.5-15, for example, the ratio may be 1:2:7.5, 1:2:8, 1:2:9, 1:2:10, 1:2:11, 1:2:12, 1:2:14, 1:2:15, 1:3:7.5, 1:3:8, 1:3:10, 1:3:12, 1:3:14 or 1:3:15.

The transition layer and the reinforcement layer are conventional structures in the art, and a person skilled in the art could select respective compositions thereof according to requirements, and the present disclosure does not limit the same in any way.

In an embodiment, the transition layer contains a second binder, a second sand material, and a second powder, and the reinforcement layer contains a third binder, a third sand material, and a third powder.

In the present disclosure, the second binder, the second sand material, and the second powder, and the third binder, the third sand material, and the third powder may be independently the same as or different from the first binder, the first sand material, and the first powder, respectively, as long as the performance requirements of the mold shell can be satisfied. The present disclosure has no limitation thereto. They are well known in the art, and are not repeated herein.

Optionally, the second binder and the third binder also may be the same as or different from the first binder, respectively, optionally the same.

Optionally, the third sand material is larger than the second sand material in dimension, and the second sand material is larger than the first sand material in dimension. This optional embodiment is more conducive to economical manufacturing of the mold shell, and the strength of the mold shell is also optimal.

The mold shell provided in the present disclosure has very high inertia to the magnesium alloy pouring liquid during casting, and has an excellent protective effect.

Some embodiments of the present disclosure further provide a method for preparing the above high-inertia mold shell for casting, including: preparing a surface layer slurry and preparing a surface layer sand material, and introducing an inorganic compound into the surface layer slurry and/or the surface layer sand material.

In the present disclosure, it can be understood that the surface layer slurry and the surface layer sand material are used for preparing the surface layer.

In the present disclosure, the inorganic compound can be introduced into the surface layer slurry, the inorganic compound also can be introduced into the surface layer sand material, and the inorganic compound also can be introduced into the surface layer slurry and the surface layer sand material separately at the same time. Optionally, in the third mode, the inorganic compound is further dispersed in the formed surface layer in a more uniform manner, which can facilitate the formation of a protective molten film with a uniform thickness.

In some embodiments, the proportion of the inorganic compound introduced into the surface layer slurry and the surface layer sand material can be selected based on the third mode. Optionally, a weight ratio of the inorganic compound introduced into the surface layer slurry to the inorganic compound introduced into the surface layer sand material is 1:8-30, such as 1:9-28, 1:12-25, or 1:15-20. At the above optional weight ratios, the inorganic compound is better dispersed in the surface layer.

According to the present disclosure, a particle size of the inorganic compound can be selected from a wider range. Optionally, the particle size of the inorganic compound is 100-300 mesh, for example, the particle size may be 120-280 mesh, 140-250 mesh or 160-210 mesh. The inorganic compound, with the particle size being within the above range, can be effectively attached to the surface of the surface layer sand material, which is beneficial to uniformly and widely filling pores when the inorganic compound is melted, and a uniform protective dense film with a suitable thickness is formed. If the particle size is too large, the inorganic compound is not easy to attach, a film subsequently formed by melting is relatively poor, and the protective effect is relatively bad. Optionally, the inorganic compound has a particle size of 200-300 mesh. In this optional embodiment, the inorganic compound will be further better attached to the surface of the surface layer sand material, and further facilitates uniformly and widely filling pores when the inorganic compound is melted, and a uniform protective dense film with a suitable thickness is formed.

According to the present disclosure, the surface layer slurry further may contain conventional components such as a binder, and a person skilled in the art could make a selection freely according to requirements.

In an optional embodiment, the first binder and the first powder are further introduced into the surface layer slurry, and a weight ratio of the first powder to the first binder in the surface layer slurry is 1-10:1, such as 1:1, 2:1, 3:1, 4:1, 5:1, 6:1, 7:1, 8:1, 9:1 or 10:1.

In an optional embodiment, the surface layer slurry is composed of a first binder, an inorganic compound, and optional water. In this optional embodiment, the inorganic compound of the present disclosure can serve as a protective agent and also can act as a powder for the surface layer molding, without the need of adding a powder.

In another embodiment, the surface layer slurry is composed of a first binder, a first powder, an inorganic compound, and optional water.

A person skilled in the art could select the amount of water in the surface layer slurry according to requirements for preparing or molding the surface layer, so as to adjust the viscosity of the surface layer slurry; in the above, the amount of water may be embodied in the form of water in sol of the binder, and also may be introduced separately. For example, optionally, the viscosity of the surface layer slurry is 20-26 seconds as measured by a flow cup (Chinese flow cup).

In the present disclosure, respective amounts of the surface layer slurry and the surface layer sand material are such that the surface layer of the desired components can be prepared.

The surface layer sand material of the present disclosure may consist of a single component, and also may consist of a plurality of components.

Optionally, a first sand material is further introduced into the surface layer sand material, wherein a weight ratio of the inorganic compound to the first sand material in the surface layer sand material is 15-40:100, for example, the weight ratio may be 15-35:100, 15-30:100 or 20-30:100, such as 15:100, 20:100, 25:100, 30:100, 35:100 or 40:100.

In the preparation method provided in the present disclosure, types of the first binder, the first powder, and the first sand material are in the same optional ranges as the types of corresponding components in the first aspect, and will not be described again herein.

In addition to the preparation of the above surface layer, the preparation method provided in the present disclosure further may include the preparation of other conventional layers, which is well known in the art and does not involve any inventive effort.

In an optional embodiment, the method for preparing the high-inertia mold shell for casting further includes the following steps:

(1) covering the surface layer slurry and the surface layer sand material in sequence on a wax mold surface, and then performing first drying for forming a surface layer;
(2) making a transition layer and a reinforcement layer in sequence on a surface of the surface layer; and
(3) sealing a surface of a product obtained in step (2), followed by drying, wax mold removal, and shell baking.

Optionally, in step (1), the temperature of the first drying is 20-24° C., such as 20° C., 21° C., 22° C., 23° C. or 24° C.; and the first drying lasts for 5-15 h, such as 5 h, 7 h, 9 h, 11 h, 12 h, 14 h or 15 h.

In the present disclosure, the wax mold is well known to a person skilled in the art, and will not be described herein again.

In step (2) of the present disclosure, any existing method can be used for the process of preparing the transition layer and the reinforcement layer, which is not limited in any way in the present disclosure.

In an optional embodiment, the process of preparing the transition layer and the reinforcement layer includes:

(2-1) covering the surface of the product obtained in step (1) with a transition layer slurry and a second sand material in sequence, followed by second drying to form a transition layer; and
(2-2) covering the surface of the product obtained in step (2-1) with a reinforcement layer slurry and a third sand material in sequence, followed by third drying to form a reinforcement layer.

In the present disclosure, conditions of the second drying and the third drying are not limited in any way, and could be conventionally selected by a person skilled in the art. Exemplarily, the second drying and the third drying each independently last for 20-30 hours, at a temperature of 20-24° C. Drying methods include, but are not limited to, accelerated air blow drying.

Optionally, the transition layer slurry may include a second binder and a second powder, and the reinforcement layer slurry may include a third binder and a third powder. The second binder and the third binder each may independently include a silicon-containing binder in various forms (for example, containing water or not), optionally including at least one of silica sol, water glass, and ethyl silicate solution. Optional ranges of the second powder and the third powder are the same as those in the first aspect, and details are not repeatedly described herein.

The amounts of the second binder, the third binder, the second powder, the third powder, the third sand material, the second sand material, and the first sand material all satisfy the compositions of each corresponding component in the first aspect.

A person skilled in the art could select a sand material of a suitable dimension according to properties such as molding and strength of the mold shell, and optionally the third sand material is larger than the second sand material in dimension, and the second sand material is larger than the first sand material in dimension. This optional embodiment is more conducive to forming the mold shell with appropriate strength.

Exemplarily, the dimension of the first sand material is 90-130 mesh, the dimension of the second sand material is 60-90 mesh, and the dimension of the third sand is 10-30 mesh.

In the present disclosure, a person skilled in the art could optionally repeat step (2-2) multiple times depending on the dimension of workpiece to be cast. If the workpiece is large, the step (2-2) is repeated for more times, so that the obtained mold shell is thicker, and if the workpiece is small, the step (2-2) is repeated for fewer times, so that the obtained mold shell is thinner.

In some embodiments, in step (3) of the present disclosure, the processes of scaling, drying, wax mold removal, and shell baking all can be carried out by existing methods, which are prior art and will not be repeated herein. Exemplarily, a slurry used for the sealing may include a binder (for example, silica sol) and a powder (for example, mullite powder). Exemplarily, the shell baking may be carried out at a temperature of 500-1100° C. for 2-4 h.

Some embodiments of the present disclosure further provide a method for improving precision of a magnesium alloy cast. The high-inertia mold shell for casting in the first aspect is used for precision casting.

Some embodiments of the present disclosure further provide use of the above high-inertia mold shell for casting in improving precision of a magnesium alloy cast.

In some embodiments, a high-inertia mold shell for casting is used for precision casting in the preparation of the magnesium alloy cast.

In the present disclosure, by adding the inorganic compound having a specific melting point and a specific boiling point into the surface layer of the mold shell, after the magnesium alloy pouring liquid is poured, the mold shell is heated, the specific inorganic compound can melt and expand to form a molten state, and can fill the pores in the surface layer of the mold shell to block the pores of the surface layer, so as to isolate the magnesium and the mold shell, and isolate the oxygen in the air from further reaction with the magnesium in the magnesium alloy pouring liquid, thus forming the high inertia.

In the embodiment where the inorganic compound is optional boric anhydride in the present disclosure, the reaction $B_2O_3+3Mg=2B+3MgO$ also will take place, and the simple substance boron generated will be embedded into the surface film of magnesium oxide to enable the same to become a denser oxide film, thereby achieving the purpose of further isolating the magnesium and the mold shell, thus producing a stronger protective effect in cooperation with a blocking melt layer.

The high-inertia mold shell for casting provided in the present disclosure overcomes the defect existing in the prior art that the mold shell cannot protect the magnesium alloy in precision casting of the magnesium alloy cast. In the precision casting of magnesium alloy, as the dense protective film can be formed during pouring, the magnesium in the magnesium alloy pouring liquid is prevented from being consumed (for example, oxidized) in a large amount, thus the surface is complete after the magnesium alloy pouring liquid is solidified, and further the precision of the magnesium alloy cast can be improved.

EXAMPLES

The present disclosure will be described in more detail below with reference to examples. In the above, the silica sol used has the same concentration.

Example 1

I. Process for Preparing a Mold Shell:

1. preparing a wax mold;
2. preparing a surface layer slurry: the components were silica sol (water contained therein satisfies the viscosity of the surface layer slurry) and mullite powder (200-300 mesh) and 300-mesh boric anhydride, the mass ratio of the mullite powder to the silica sol was 2.2:1 based on a wet weight, and the viscosity of the surface layer slurry was 24 seconds as measured by a Chinese flow cup;
3. spreading a surface layer sand material (120-mesh corundum sand and 300-mesh boron anhydride, a mass ratio of the boron anhydride to the corundum sand being 25:100); a total amount of boron anhydride added being 15 wt % of the total amount of surface layer raw materials based on a wet weight of the surface layer;
4. drying at 24° C. for 12 hours to form a surface layer, wherein the thickness of the first surface layer was 0.5 mm;
5. applying a transition layer slurry (components of the slurry were silica sol and mullite powder, and a mass ratio of the mullite powder to the silica sol was 2.5:1 based on the wet weight);
6. spreading a transition layer sand (60-90-mesh mullite sand, being coarser than the sand of the surface layer, with the amount being 3 times the mass of the mullite powder), so that it was uniformly applied on the surface of the mold shell;
7. drying at 24° C. for 24 hours to form a transition layer, wherein the thickness of the transition layer was 1.2 mm;
8. applying a reinforcement layer slurry (components of the slurry were silica sol and mullite powder, and a mass ratio of the mullite powder to the silica sol was 2.3:1 based on the wet weight);
9. spreading a reinforcement layer sand (10-30-mesh mullite sand, being coarser than the sand of the transition layer, with the amount being 3 times the mass of the mullite powder in the reinforcement layer slurry), so that it was uniformly applied on the surface of the mold shell;
10. drying at 24° C. for 24 hours to form a reinforcement layer, wherein the thickness of the reinforcement layer was 7 mm;
11. sealing (components of the slurry were silica sol and mullite powder, and a mass ratio of the mullite powder to the silica sol was 2:1 based on the wet weight), wherein this slurry is thinner;
12. drying at 24° C. for 8 hours;
13. de-waxing for later use; and
14. baking the shell at a temperature of 850° C. for 4 hours, to obtain a mold shell. The mold shell was 8.7 mm thick.

II. Pouring a Magnesium Alloy Pouring Liquid

A magnesium alloy metal liquid at 750° C. was poured into the mold shell prepared above, and a magnesium alloy cast was obtained after solidification.

In the above, after the magnesium alloy metal liquid was poured, the mold shell was heated, the boron anhydride melted and expanded, to block pores of the surface layer so as to isolate oxygen in the air to further react with magnesium. Secondly, a reaction $B_2O_3+3Mg=2B+3MgO$ was taken place, and a simple substance boron generated was embedded into a surface film of magnesium oxide to enable the same to become a dense oxide film, thereby achieving the purpose of isolating the magnesium and the mold shell, thus producing a stronger protective effect in cooperation with the blocking melt solution.

According to GB/T6061.1-1997, the surface roughness of the above magnesium alloy cast was measured to be 1.5 μm. Moreover, the cast had a uniform color on the surface, without oxidation phenomenon.

Example 2

The method according to Example 1 was followed, except that the total amount of the boron anhydride added was 14 wt % of the total amount of the raw materials of the surface layer based on the wet weight of the surface layer.

According to GB/T6061.1-1997, the surface roughness of the above magnesium alloy cast was measured to be 1.7 μm. Moreover, the cast had a uniform color on the surface, without oxidation phenomenon.

Example 3

The method according to Example 1 was followed, except that the total amount of the boron anhydride added was 19 wt % of the total amount of the raw materials of the surface layer based on the wet weight of the surface layer.

According to GB/T6061.1-1997, the surface roughness of the above magnesium alloy cast was measured to be 3.0 μm. Moreover, the cast had a uniform color on the surface, without oxidation phenomenon.

Example 4

The method according to Example 1 was followed, except that no boron anhydride was added when the surface layer sand material was spread, and the amount of boron anhydride added to the surface layer slurry was the same as the total amount added in Example 1.

According to GB/T6061.1-1997, the surface precision of the above magnesium alloy cast was measured to be 30 μm. Moreover, a small amount of oxidation phenomenon occurred on a part of the surface of the cast.

Example 5

The method of Example 1 was followed, except that sodium fluoride was used to replace the boron anhydride in the surface layer slurry and the surface layer sand material, respectively, and the use amount was unchanged.

According to GB/T6061.1-1997, the surface precision of the above magnesium alloy cast was measured to be 28 μm. Moreover, a small amount of oxidation phenomenon occurred on a part of the surface of the cast.

Example 6

The method of Example 1 was followed, except that borax was used to replace the boron anhydride in the surface layer slurry and the surface layer sand material, respectively, and the amount was unchanged.

According to GB/T6061.1-1997, the surface precision of the above magnesium alloy cast was measured to be 25 μm. Moreover, a small amount of oxidation phenomenon occurred on a part of the surface of the cast.

Example 7

The method of Example 1 was followed, except that boron anhydride introduced respectively into the surface layer slurry and the surface layer sand material was 100-120 mesh.

According to GB/T6061.1-1997, the surface precision of the above magnesium alloy cast was measured to be 6.4 μm. Moreover, the cast has a uniform color on the surface, without oxidation phenomenon.

Example 8

The method of Example 1 was followed, except that the weight ratio of the boron anhydride to the corundum sand introduced into the surface layer slurry was 40:100.

According to GB/T6061.1-1997, the surface precision of the above magnesium alloy cast was measured to be 5.2 μm. Moreover, the cast had a uniform color on the surface, without oxidation phenomenon.

It can be seen from the above examples that, by using the embodiments of the present disclosure, a good protective effect can be achieved, and the precision of the magnesium alloy cast can be improved.

It can be seen from Example 1 and Example 3 that, by using the solution with a suitable use amount of boron anhydride in the present disclosure, the precision of the cast can be higher. It can be seen from Example 1 and Example 4 that the effect can be further enhanced by introducing the boron anhydride into both the surface layer sand material and the surface layer slurry. It can be seen from Example 1 and Examples 5 and 6 that, compared with sodium fluoride and borax, the use of boron anhydride can further form a dense oxide film, which can further improve the effect. It can be seen from Example 1 and Example 7 that the precision of the obtained cast is higher by using the solution with optional boron anhydride having a specific particle size. It can be seen from Example 1 and Example 8 that the precision of the obtained cast is higher by using the solution with the optional surface layer sand material.

INDUSTRIAL APPLICABILITY

The present disclosure provides a high-inertia mold shell for casting and a preparation method thereof and a method for improving precision of magnesium alloy cast. The high-inertia mold shell for casting provided in the present disclosure overcomes the defect existing in the prior art that the mold shell cannot protect the magnesium alloy in precision casting of the magnesium alloy cast. In the precision casting of magnesium alloy, as a dense protective film can be formed during pouring, the magnesium in the magnesium alloy pouring liquid is prevented from being consumed (for example, oxidized) in a large amount, thus the surface is complete after the magnesium alloy pouring liquid is solidified, further the precision of the magnesium alloy cast can be improved, therefore, the present disclosure has excellent industrial applicability.

What is claimed is:

1. A mold shell for casting, comprising a surface layer, which is configured to contact a magnesium alloy pouring liquid, wherein the surface layer contains an inorganic compound, and the inorganic compound is at least one selected from the group consisting of boric anhydride, borax, potassium fluoride, and sodium fluoride, wherein based on a total amount of raw materials of the surface layer, a content of the inorganic compound accounts for 10-40 wt %, and wherein a ratio of a thickness of the surface layer to a total thickness of the mold shell for casting is 2.5-25:100.

2. The mold shell for casting according to claim 1, wherein the content of the inorganic compound accounts for 10-30 wt %.

3. The mold shell for casting according to claim 1, wherein the inorganic compound is boric anhydride.

4. The mold shell for casting according to claim 1, wherein the surface layer further contains a first binder, a first sand material, and an optional first powder, and based on the total amount of raw materials of the surface layer, a content of the first binder, by wet weight, accounts for 5-15 wt %, a content of the first powder accounts for 0-25 wt %, and a content of the first sand material accounts for 20-85 wt %.

5. The mold shell for casting according to claim 1, wherein the mold shell for casting has a total thickness of 4-20 mm, and the surface layer has a thickness of 0.5-1 mm.

6. The mold shell for casting according to claim 1, wherein the mold shell for casting further comprises:

a transition layer, which is provided on a side of the surface layer; and a reinforcement layer, which is provided on a side of the transition layer away from the surface layer, wherein a ratio of a thickness of the surface layer, a thickness of the transition layer, and a thickness of the reinforcement layer is 1:2-3:7.5-15.

* * * * *